US008141744B2

(12) United States Patent
Quinlan

(10) Patent No.: US 8,141,744 B2
(45) Date of Patent: Mar. 27, 2012

(54) FOAM DISPENSER HAVING SELECTIVELY PRESSURIZED CARTRIDGE

(75) Inventor: Robert L. Quinlan, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 699 days.

(21) Appl. No.: 12/288,824

(22) Filed: Oct. 23, 2008

(65) Prior Publication Data

US 2010/0102083 A1 Apr. 29, 2010

(51) Int. Cl.
*B67D 1/00* (2006.01)

(52) U.S. Cl. ..... 222/61; 222/190; 222/325; 222/401

(58) Field of Classification Search ..... 222/52, 222/61, 190, 195, 396, 397, 400.5, 401, 333, 222/334, 325
See application file for complete search history.

(56) References Cited

U.S. PATENT DOCUMENTS

| | | | | |
|---|---|---|---|---|
| 3,112,844 | A * | 12/1963 | Keller et al. | 222/61 |
| 5,012,957 | A * | 5/1991 | Mihail | 222/190 |
| 5,398,845 | A | 3/1995 | Meyer | |
| 5,439,140 | A | 8/1995 | Meyer | |
| 5,544,788 | A | 8/1996 | Meyer | |
| 5,842,607 | A * | 12/1998 | Snider | 222/145.6 |
| 6,053,369 | A * | 4/2000 | Hoang et al. | 222/190 |

FOREIGN PATENT DOCUMENTS

| | | |
|---|---|---|
| EP | 0990412 | 8/1993 |
| WO | 90/14037 | 11/1990 |
| WO | 2005/112724 | 12/2005 |

* cited by examiner

*Primary Examiner* — J. Casimer Jacyna
(74) *Attorney, Agent, or Firm* — Renner Kenner Greive Bobak Taylor & Weber

(57) ABSTRACT

A foam dispenser having a selectively pressurized cartridge that includes a dispenser housing maintaining a motor driving an air compressor with a compressed air conduit extending therefrom. Also maintained within the dispenser is a foam generating head that receives air and liquid conduits that include dispensing valves. A control circuit controls the motor and dispensing valves, and further is interconnected with a hand sensor positioned in association with the dispensing head. In one embodiment of the invention, a disposable and replaceable cartridge of liquid soap or the like is adapted to sealingly and removably receive the compressed air conduit as well as the liquid and air outlet conduits, along with a vent valve and a pressure sensor, the vent valve and pressure sensor communicating with a control circuit. In another embodiment, the various conduits, valves and sensors, as well as the dispensing head, comprise a portion of the cartridge. The control circuit, upon sensing the presence of the user's hands, activates the motor and air compressor to generate a pressure head in the cartridge and the dispensing valves are activated when the pressure sensor determines that a pressure head sufficient for dispensing has been generated. The motor and compressor are turned off at an appropriate time in association with the activation of the dispensing valves. The vent valve is activated at the end of the dispensing cycle.

11 Claims, 2 Drawing Sheets

FOAM DISPENSER HAVING SELECTIVELY PRESSURIZED CARTRIDGE

TECHNICAL FIELD

The invention herein resides in the art of dispensing systems and, more particularly, to such dispensers adapted for dispensing materials in the nature of a foam. Specifically, the invention relates to a soap foam dispenser, in which a liquid soap is converted into foam by the forceful combination of liquid soap and air in a foaming head. More particularly, the invention relates to a soap foam dispenser having a disposable cartridge and adapted for interconnection with a motor-driven air compressor under control of a control circuit to selectively regulate the pressurization of the cartridge and the requisite dispensing of liquid and air to a foam generating head to create the desired soap foam.

BACKGROUND OF THE INVENTION

Presently in the art of dispensing liquids and gels, it has become desirable to dispense such liquids and gels in the form of a foam. Typically, the foam is generated from combining a liquid or gel material with air in a forceful way, with the combination of air and the liquid or gel then being extruded through a screen, mesh, sponge or the like to obtain a foam of substantially uniform bubbles.

The invention herein will be discussed with regard to soap foam dispensers, in which liquid soap and air are combined as described for achieving the requisite foam. However, it will be appreciated that the concepts of the invention may be extended to the generation of foam from other liquids, gels, and the like, including those of alcohol-based sanitizers. Presently, soap foam is generated in a variety of ways, most of which require the depositing of a quantity of liquid soap in one chamber, an amount of air in another chamber, and compressing the two chambers to forcefully drive liquid and air to a foam generating head for the generation of the foam. Such activities require significant mechanical movement, typically employing a pair of pistons, one for liquid and one for air, to drive the separate quantities to the foam generating member. Typically, these dual chambered pumps are an integral portion of disposable cartridges and add significantly to the cost of such cartridges. Moreover, being of a mechanical nature, the pumps are not given to excessive use and are typically designed to have a useful life only slightly exceeding the number of dispensing cycles available from the cartridge.

Heretofore, the art has been substantially devoid of a soap foam dispenser having the economy of a permanent compressor adapted for intercommunication with replaceable cartridges to drive both the liquid and air portions necessary to generate soap foam at a foam generating head. The instant invention fills that void.

DISCLOSURE OF THE INVENTION

In light of the foregoing, it is a first aspect of the invention to provide a foam dispenser having a selectively pressurized cartridge in which the disposable cartridge is devoid of any pump mechanism.

A further aspect of the invention is to provide a foam dispenser having a selectively pressurized cartridge in which the cartridge is disposable.

Yet a further aspect of the invention is the provision of a foam dispenser having a selectively pressurized cartridge in which an air compressor is maintained as a fixed portion of the dispenser and is adapted for communication with disposable cartridges, and in which the compressed air from the air compressor is adapted for driving both the liquid and air portions necessary for generating foam.

Another aspect of the invention is the provision of a foam dispenser having a selectively pressurized cartridge in which the cartridge is adapted for interconnection between a permanent air compressor and dispensing head, and in which the cartridge is also adapted to receive a vent valve and pressure sensor, all under control of a control circuit which is a constituent part of the dispenser.

It is still a further aspect of the invention to provide a foam dispenser having a selectively pressurized cartridge which is cost effective and easy to implement with state of the art structures and materials.

The foregoing and other aspects of the invention that will become apparent as the detailed description proceeds are achieved by a foam dispenser, comprising: a housing; a cartridge received within said housing, said cartridge comprising an interior having a liquid section and an air section; an air compressor in selective communication with said air section; a foam generating head; an outlet air conduit extending between said air section and said foam generating head; an outlet liquid conduit extending between said liquid section and said foam generating head; and wherein said air compressor generates a pressure head in said air section, said pressure head separately forcing both air and liquid respectively through said outlet air and liquid conduits to said foam generating head.

Other aspects of the invention that will become apparent herein are attained by a foam dispenser, comprising: a housing; and a cartridge received within said housing, said cartridge comprising an interior having a liquid section and an air section, air in said air section being in direct contact with liquid in said liquid section, said cartridge further bing adapted to receive a compressed air inlet and liquid and compressed air outlets.

DESCRIPTION OF DRAWINGS

For a complete understanding of the various aspects and techniques of the invention, reference should be made to the following detailed description and accompanying drawings wherein.

BEST MODE FOR CARRYING OUT THE INVENTION

Figure 1:
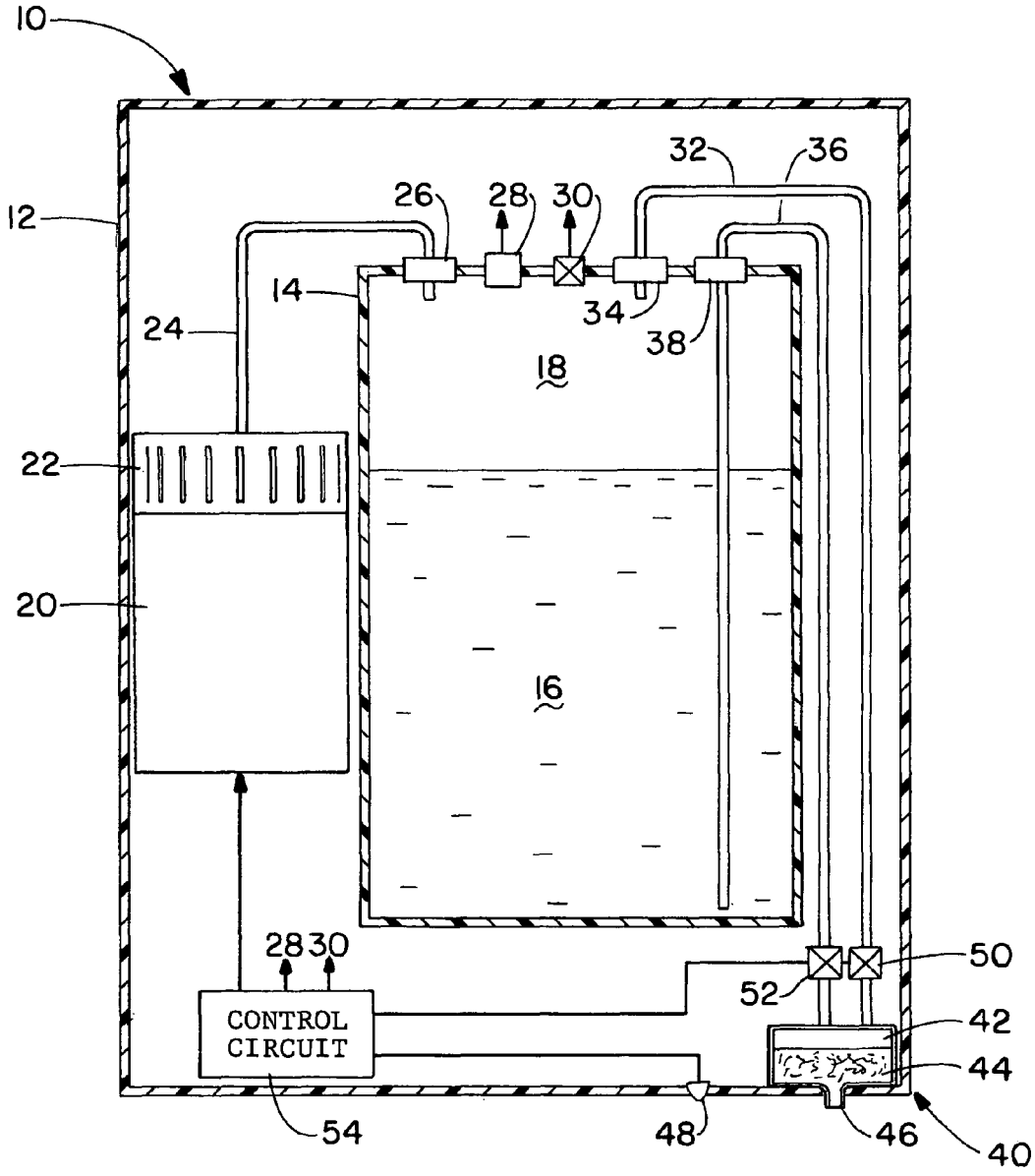
FIG. 1 is an illustrative sectional view of a foam dispenser having a selectively pressurized cartridge therein, made in accordance with the invention.

Referring now to the drawings and more particularly FIG. 1, it can be seen that a foam dispenser according to the invention is designated generally by the numeral 10. The foam dispenser 10 is defined by a housing 12 of a somewhat standard nature. Such dispensers are now commonly known, with the dispenser 10 being of the general wall-mount configuration. Typically, the housing 12 will have a hinged front or cover to allow access to the interior thereof for replacement of the cartridge 14, as desired. The cartridge 14 maintains therein a liquid or gel such as those employed in generating soap or sanitizing foams. The cartridge 14 is a removable, disposable and replaceable cartridge, as that feature is readily known and understood in the art. Typically, the cartridge 14 is a blow-molded cartridge of an appropriate plastic material.

The cartridge 14 is adapted to maintain therein a fluid 16 in a lower portion thereof, with air 18 being maintained thereabove. The fluid 16 and air 18 comprise substantially the entirety of the interior of the cartridge 14, with the air and fluid being in contact with each other, without the use of a separating bladder, membrane or the like. As will become apparent herein, the air 18 is selectively pressurized to create a pressure head within the cartridge 14 to assist in the dispensing operation.

Received and maintained within the housing 12 is a motor 20 operative to drive an air compressor 22. A conduit 24 extends from the air compressor 22 to a removable plug seal 26 maintained in the top of the canister 14. The plug seal 26 is adapted to seal an aperture in the top of the cartridge 14 and to also seal about the exterior of the conduit 24, such that conduit 24 can pass into the air head 18 of the cartridge 14 in a sealed manner.

Also received within a top of the disposable cartridge 14 by means of removable plug seals are a pressure sensor 28 and a vent valve 30. The pressure sensor 28 produces a signal corresponding to the pressure head in the air portion 18 of the cartridge 14, while the vent valve 30 is operative to vent the air chamber 18 to atmosphere, as desired.

An air conduit 32 is received by a removable plug seal 34 and extends into the air head 18, as shown. Similarly, a liquid conduit 36 is received by a removable plug seal 38 to pass into the interior of the cartridge 14 and to the bottom portion thereof retaining the liquid 16 to ensure dispensing of the entire contents of the cartridge 14.

The air conduit 32 and liquid conduit 36 extend to a foam generator and dispensing head 40, as shown. The foam generating head 40 includes a mixing chamber 42 having an extruding chamber 44 therebeneath. Those skilled in the art will appreciate that the mixing chamber is substantially a void area in which the liquid soap and air are forcefully combined and then extruded through a screen mesh, sponge, foam block or the like comprising the element 44, and thence out of the dispensing nozzle 46.

Also included as a part of the foam dispenser 10 is a hand detector or proximity sensor 48, which may be of any of various types understood by those skilled in the art. The hand sensor 48 emits a signal upon determining the presence of an object, typically a user's hands, within a particular region beneath the dispensing nozzle 46.

The air conduit 36 is characterized by an air dispensing valve 50, and the liquid conduit 36 by the presence of a fluid dispensing valve 52, both valves being preferably positioned in close association with the foam generating and dispensing head 40. The valves 50, 52 may be simple pinch valves operating on the flexible tubing of the conduits 32, 36, or they may have any of various structures as will be appreciated by those skilled in the art.

A control circuit 54 is maintained as an integral portion of the dispenser 10 and within the housing 12. The control circuit 54 is interconnected with the motor 20 to selectively activate the air compressor 22. Similarly, the control circuit 54 interconnects with the valves 50, 52 to selectively open and close such valves. The hand sensor 48 is connected to the control circuit 54 to provide a signal when hands are present. Similarly, the pressure sensor 28 is interconnected with the control circuit 54 to provide a signal indicative of the pressure head in the air space 18 of the cartridge 14. Finally, the control circuit 54 is also interconnected with the vent valve 30 to allow for venting of the air head 18 to atmosphere. Those skilled in the art will appreciate that the valves 30, 50, 52 may be of various types, while conforming with the concepts of the invention. While they may all be controlled by the control circuit 54, it is contemplated that they may be self-regulating, automatically controlled as by a set cracking pressure or the like.

From a structural standpoint, it will be appreciated that motor 20, compressor 22, conduits 24, 32, 36, sensors 28, 48, and valves 30, 50, 52, as well as the foam generating head 40 may substantially all be a permanent part of the dispenser 10 and its housing 12. Each of the disposable cartridges 14 may be adapted to receive, by the use of removable plug seals, the conduits 24, 32, 36, the pressure sensor 28, and the vent valve 30. Accordingly, removal and replacement of cartridges 14 and the necessary interconnections to be effected at such replacement cycle are simple and easy to undertake. Alternatively, it is contemplated that a substantial portion of the structure comprise a portion of the cartridge, being replaced with the cartridge at each such replacement. Such is particularly the case with sanitary sealed cartridges. For example, the cartridge 14 may include as an integral part thereof each of the conduits 24, 32, 36, a pressure sensor 28 (if required), and a vent valve 30 (either self-regulating or externally controlled). The cartridge may also contain, as a part thereof, the foam generating head 40, and appropriate dispensing valves 50, 52. It will be appreciated that various combinations of elements may comprise the disposable cartridge 14, or be a permanent part of the dispenser 10.

Figure 2:
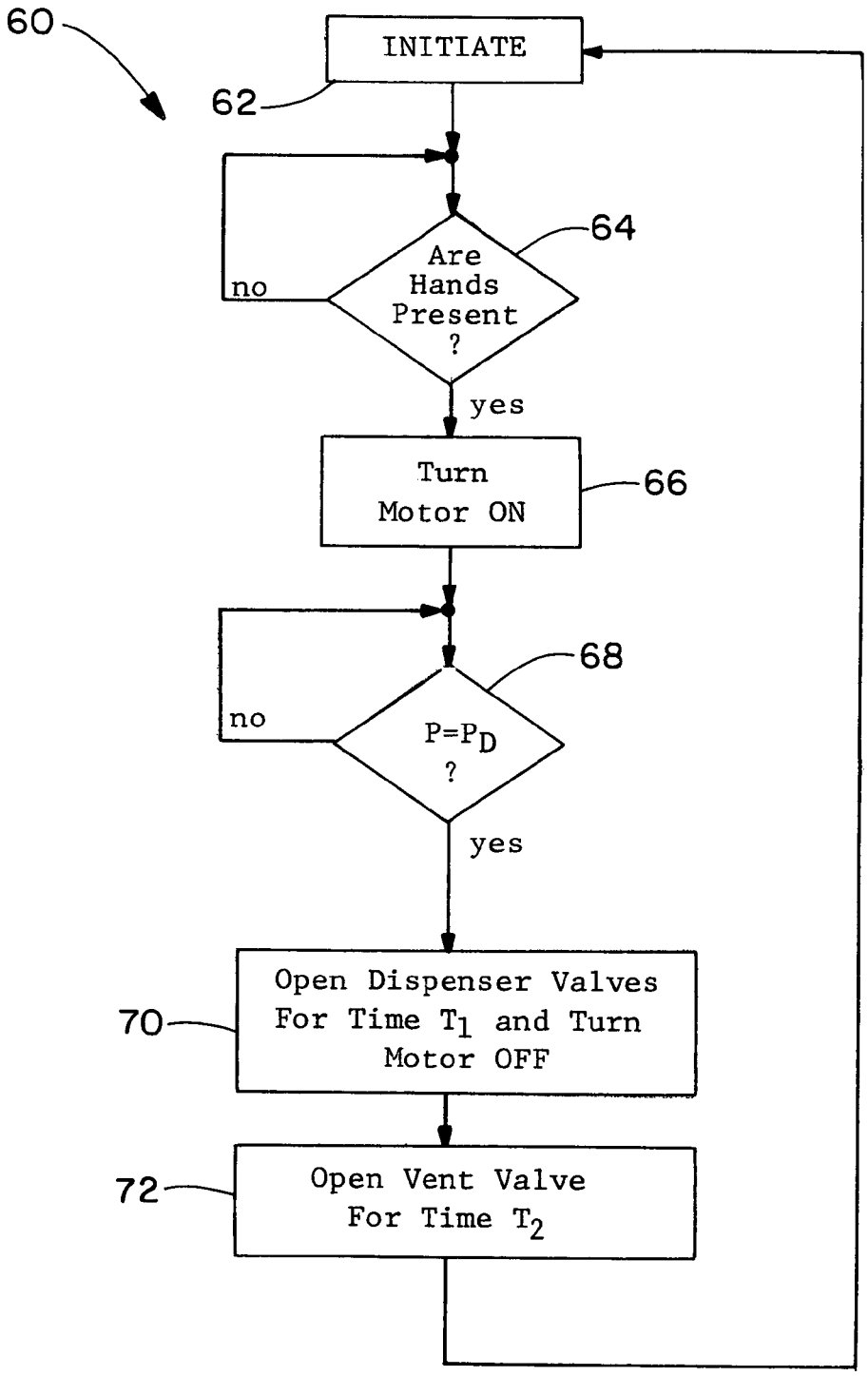
FIG. 2 is a flow diagram showing the operation of the structure of FIG. 1.

The control circuit 54 may operate the motor and various valves in conjunction with the sensors 28, 48 in any of numerous manners. The flexibility of the operational mode is apparent, in that the control circuit 54 may comprise a simple programmable chip, the program achieving the desired operation. One such operation is illustrated in the flow chart of FIG. 2, in which a method of operation of the foam dispenser 10 is designated generally by the numeral 60. An initiate cycle 62 resets the control circuit 54 and ensures closure of the valves 30, 50, 52, as desired. Following the initiate cycle at 62, the hand sensor 48 is monitored as at 64 to determine if hands are present. That monitoring continues until a determination is made that hands are present, in which case the motor 20 is activated as at 66, which in turn activates the compressor 22 to provide compressed air through the conduit 24 and into the air head 18. The control circuit 54 continues to monitor the pressure in the head 18 through the pressure sensor 28, as is apparent from FIG. 1 and FIG. 2. When the pressure P maintained in the head 18 is equal to dispensing pressure $P_D$, a determination is made that dispensing can be engaged. At this time, the control circuit 54 opens the dispensing valves 50, 52 to allow for air to be driven from the head 18 through the conduit 32 and valve 50 into the mixing chamber 42. Simultaneously, actuation of the valve 52 allows for liquid to be driven from the section 16 of the cartridge 14, through the conduit 36 and into the mixing chamber 42. The valves 50, 52 remain open for a predetermined time $T_1$, this time being an adequate time cycle for dispensing a predetermined volume of foam. The air and liquid are mixed together in the mixing chamber 42 and extruded through the medium 44 and out of the nozzle 46, as will be readily appreciated by those skilled in the art.

It will be understood that when the dispensing valves are opened as at 70, the motor 20 may be turned off under control of the control circuit 54. If desired, the motor and compressor may remain on and operative during the dispensing cycle, or the same can be turned off prior to the dispensing cycle, relying upon the pressure head within the region 18 of the cartridge 14 to effect the dispensing of air and liquid necessary for generating foam. In either event, once the motor 20 and compressor 22 have been turned off and the dispensing cycle has been terminated, action is undertaken at 72 to open the vent 30 to vent the pressure head in the area 18 to atmosphere. The valve 30 may be opened for a set period of time $T_2$ sufficient for such venting, or the valve 30 may be opened to atmosphere until the pressure sensor 28 emits a signal indicating the absence of pressure or the presence of atmospheric pressure. In any event, venting through the valve 30 is desired to prevent overpressurization of the cartridge 14, which may result in a leak on excessively forceful dispensing of foam.

Those skilled in the art can readily appreciate various types of dispensing cycles that might be undertaken with the system of FIG. 1. For example, it may be desired to open the valve 52 slightly ahead of the valve 50 to allow entry of liquid soap into the mixing chamber 42 slightly ahead of the compressed air, to effect a better blending and generation of foam, if such is found to be the case. As mentioned above, the timing of turning the motor 20 and compressor 22 on and off may also be varied. The motor may be turned off prior to the dispensing cycle, during the dispensing cycle, or following the dispensing cycle, determined by the sequence that results in the best quality of foam, which also depends upon the liquid soap being sued.

Thus it can be seen that the various aspects of the invention have been attained by the structure presented and describe above. While in accordance with the patent statutes only the best mode and preferred embodiment of the invention has been presented and described in detail, it will be understood that the invention is not limited thereto or thereby. Accordingly, for an appreciation of the true scope and breadth of the invention reference should be made to the following claims.

What is claimed is:

1. A foam dispenser comprising:

a housing;

a cartridge received within said housing, said cartridge comprising an interior having a liquid section and an air section;

an air compressor in selective communication with said air section;

a foam generating head;

an outlet air conduit extending between said air section and said foam generating head;

an outlet liquid conduit extending between said liquid section and said foam generating head;

a pressure sensor and vent valve received by said cartridge, wherein said air compressor generates a pressure head in said air section, said pressure head separately forcing both air and liquid respectively through said outlet air and liquid conduits to said foam generating head a hand sensor for detecting the presence of a user's hands at said foam generating head; and an air dispensing valve in said outlet air conduit and a liquid dispensing valve in said outlet liquid conduit.

2. The foam dispenser according to claim 1, further comprising a control circuit interconnected with said hand sensor, compressor, air dispensing valve, liquid dispensing valve, pressure sensor and vent valve.

3. The foam dispenser according to claim 2, wherein said control circuit comprises a timer for activating said air and liquid dispensing valves for predetermined periods of time.

4. The foam dispenser according to claim 3, wherein said foam generating head comprises a mixing chamber receiving said outlet air conduit and outlet liquid conduit, an extruding chamber in communication with said mixing chamber, and a nozzle in communication with said extruding chamber.

5. A foam dispenser, comprising:

a housing;

a control circuit;

a pressure sensor connected to and in communication with said control circuit;

a vent valve connected to and in communication with said control circuit;

a cartridge received within said housing, said cartridge comprising an interior having a liquid section and an air section, air in said air section being in direct contact with liquid in said liquid section, said cartridge further being adapted to receive a compressed air inlet, a liquid outlet, and a compressed air outlet;

a foam generating head connected to said liquid and compressed air outlets;

a liquid outlet conduit between said foam generating head and said liquid outlet, said liquid outlet conduit having a valve therein connected to and controlled by said control circuit; and an air outlet conduit between said foam generating head and said compressed air outlet, said air outlet conduit having a valve therein connected to and controlled by said control circuit, wherein said pressure sensor monitors the pressure within said air section.

6. The foam dispenser according to claim 5, further comprising an air compressor connected to said air inlet.

7. The foam dispenser according to claim 6, wherein said cartridge is adapted to receive said inlet and outlets through removable plugs.

8. The foam dispenser according to claim 7, wherein said control circuit is connected to and selectively activates said air compressor.

9. The foam dispenser according to claim 8, further including a hand sensor for determining the presence of a user's hands, said hand sensor being connected to said control circuit.

10. The foam dispenser according to claim 9, wherein said control circuit is operative to activate said air compressor upon receipt of a signal from said hand sensor, open said dispensing valves for a preset period of time after pressure in said cartridge reaches a set level as determined by an output of said pressure sensor, and subsequently open said vent valve.

11. The foam dispenser according to claim 10, wherein said control circuit is further operative to turn off said motor when said cartridge is sufficiently pressurized to effect dispensing.

* * * * *